United States Patent [19]

Nelson et al.

[11] Patent Number: 4,468,059

[45] Date of Patent: Aug. 28, 1984

[54] BOLT UNIT FOR A LOCKSET

[75] Inventors: Kenneth R. Nelson, West Vancouver, Canada; James R. Allison, San Francisco, Calif.

[73] Assignee: Schlage Lock Company, San Francisco, Calif.

[21] Appl. No.: 338,411

[22] Filed: Jan. 11, 1982

[51] Int. Cl.[3] ..... E05C 13/00

[52] U.S. Cl. ..... 292/337; 292/1; 292/DIG. 60

[58] Field of Search ..... 292/1, 337, 169, 169.13, 292/169.21, DIG. 60, 169.23

[56] References Cited

U.S. PATENT DOCUMENTS

| | | | |
|---|---|---|---|
| 2,736,597 | 2/1956 | Russell | 292/169.13 X |
| 2,795,447 | 6/1957 | Schlage | 292/337 X |
| 3,235,301 | 2/1966 | Russell et al. | 292/337 X |
| 3,300,240 | 1/1967 | Tornoe et al. | 292/337 |

*Primary Examiner*—Richard E. Moore

*Attorney, Agent, or Firm*—Lothrop & West

[57] ABSTRACT

A bolt unit for providing different amounts of backset has a bolt housing detachably joined to any one of several subframes made up of pairs of identical side plates of different length. A bolt, reciprocable in the housing, is actuated by mechanism supported on the subframe, that mechanism including one of a selection of hooks of different lengths corresponding to the different backset lengths.

7 Claims, 10 Drawing Figures

FIG. 1
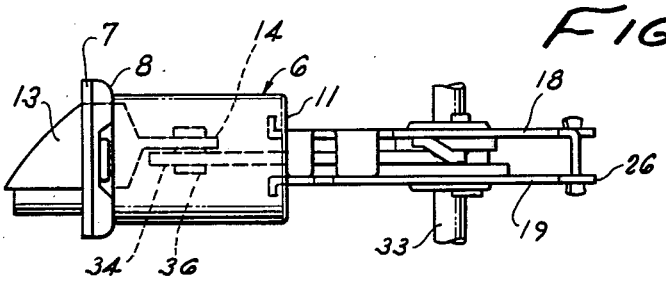
FIG. 2
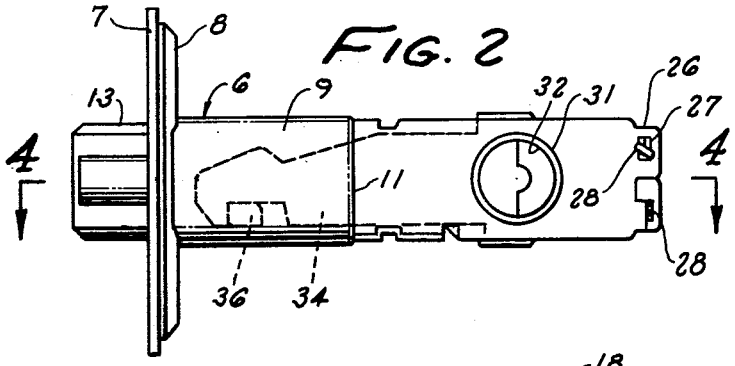
FIG. 3
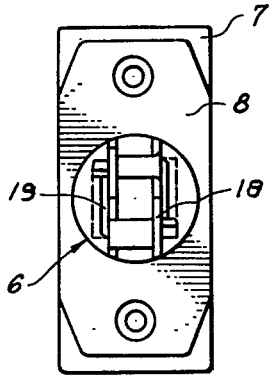
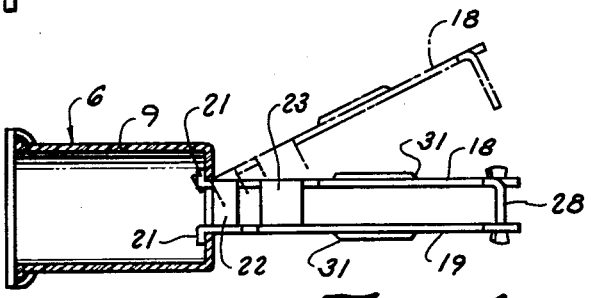
FIG. 4
FIG. 8
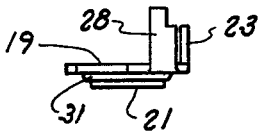
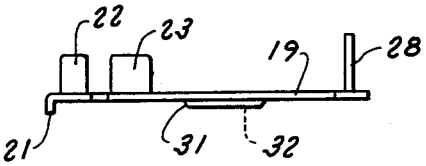
FIG. 5
FIG. 9
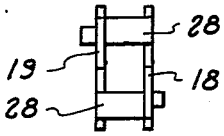
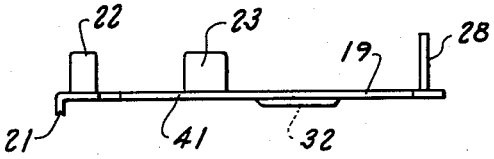
FIG. 6
FIG. 10
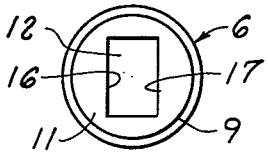
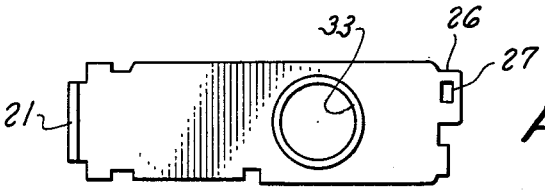
FIG. 7

BOLT UNIT FOR A LOCKSET

BRIEF SUMMARY OF THE INVENTION

A bolt unit for a lockset has a bolt housing and has any one of several subframes of different lengths releasably engaging the bolt housing and extending therefrom to support structure for actuating a bolt in the housing.

BRIEF DESCRIPTION OF THE SEVERAL VIEWS OF THE DRAWINGS

FIG. 1 is a plan of a bolt unit for a lockset constructed pursuant to the invention, various portions being broken away to reduce the size of the figure.

FIG. 2 is a side elevation of the structure shown in FIG. 1.

FIG. 3 is an end elevation showing the structure of FIG. 2.

FIG. 4 is a cross-section, the plane of which is indicated by the line 4—4 of FIG. 2.

FIG. 5 is a plan of a short side plate pursuant to the invention.

FIG. 6 is a plan of a long side plate pursuant to the invention.

FIG. 7 is a side elevation of the side plate of FIG. 6.

FIG. 8 is an end elevation of the structure shown in FIG. 5.

FIG. 9 is an end elevation of the structure shown in FIG. 2.

FIG. 10 is an end elevation of the circular housing.

DETAILED DESCRIPTION

In the installation of locksets in door panels for cooperation with strikes in related door frames, it is often necessary to provide any one of several different backsets. The backset is usually understood to be the horizontal distance between the edge of the door panel and the axis of rotation of the knob or other actuating device. For various reasons, some mechanical, some architectural, and some simply matters of choice, it is customary to afford a backset of any one of several different amounts at the initial installation. This custom involves the manufacture and stocking of locksets; particularly, latch bolts, having different dimensions to accommodate the various desirable backset choices.

It is therefore an object of the invention to provide a simplified arrangement in which a lockset can be manufactured easily as one backset or dimension or another backset dimension.

Another object of the invention is to provide an arrangement for a bolt construction that can easily be changed in the field to afford any one of several different backset lengths.

A further object of the invention is to provide an interchangeable length of bolt unit, easily manufactured and economical to stock and that can readily be assembled in an appropriate fashion for the desired installation.

Another object of the invention is to provide a bolt construction that can be changed in length by an ordinary workman and without requiring any but the most elementary tools.

A further object of the invention is to provide a bolt unit that can be assembled with any of several chosen lengths and when assembled operates as reliably and satisfactorily as a non-variable unit.

A further object is in general to afford an improved latch bolt unit.

Inasmuch as the general environment and operation of the lock unit are completely standard, they are not disclosed in detail herein, the disclosure being of that portion of the structure that can readily be varied to provide any one of several different backset lengths or dimensions. Under these circumstances, there is normally provided a circular, cylindrical housing 6 to be mounted in a recess in a door panel. The housing is interrelated with a mounting plate 7 and a housing plate 8 normally joined together to receive fasteners for holding the unit in the door panel. The housing 6 is preferably a one-piece, flanged construction that has a circular, cylindrical side wal 9 and also has a planar or flat end wall 11 with an aperture 12 therein.

Mounted to reciprocate in the housing 6 is a standard bolt 13. In this case, the bolt is a latch bolt having an engaging strap 14 thereon and provided with spring means (not shown) for urging the latch bolt into normally projected position. The opening 12 is particularly of a rectangular configuration between side edges 16 and 17 of the end wall 11 that are parallel to each other.

In accordance with the invention there is provided a pair of side plates 18 and 19, particularly to interengage with the housing 6. The side plates are preferably identical (bearing different reference numerals herein only for convenience), and each is preferably formed from an originally planar metal plate. Each longitudinally extending side plate has an angle hook 21 at one end of a dimension to pass readily through the opening 12 and then to be shifted laterally or rotated, as shown in FIG. 4, until the outside surface of the side plate abuts the adjacent edge 16 or 17 of the opening 12 with the angle hook 21 overlapping and lying immediately against the inside surface of the end wall 11.

Each side plate within it height has one or more spacers 22 and 23 bent over and extending transversely therefrom and all of substantially the same transverse length. The ends of the spacers 22 and 23 on each side plate lie in abutment with the other side plate and maintain a set minimum distance between the side plates. Furthermore, each of the side plates at one end has a coplanar lug 26 disposed on one side of the centerline of the side plate. The lug 26 has an aperture 27 therein. A narrow tab 28 is on another, wide lug on the other side of the centerline. That lug is bent at a right angle from the side plate. The tab 28 leaves a shoulder on the lug at the same distance from the side plate as the ends of the spacers 22 and 23.

The net result of this construction is that the tabs 28 are offset vertically sufficiently so that the tab on one side plate enters into the aperture 27 in the lug 26 of the other side plate. The tab shoulders maintain the parallelism of the plates 18 and 19 just as the spacers 22 and 23 do. After the tabs have been inserted in their respective lug apertures, the tabs 28 are twisted slightly by a tool such as a pair of pliers so that the lugs 26 are held against the shoulders on the tabs, and the entire side plate assembly is permenently and rigidly secured with respect to the housing 6.

The side plates 18 and 19 serve as a mounting for actuating structure. Each of the side plates has an embossment 31 therein surrounding an aperture 32 therethrough designed to receive a cross-shaft 33 or other actuator for the latch bolt. Preferably connected to the actuator 33 by appropriate intervening mechanism (not shown in detail), there is a hook 34 moving in a longitudinal direction upon rotation of the shaft 33. The hook is releasably engaged with the cross-shaft 33 and is also engaged with a lug 36 projecting laterally from the strap 14 of the bolt 13. When the shaft 33 is rotated in either direction, the hook 34 is retracted and correspondingly retracts the latch bolt 13.

Since it is particularly desired to afford different backset dimensions, the side plates 18 and 19, as shown in FIGS. 4 and 5, have a predetermined minimum dimension for the length and a corresponding minimum dimension for the distance between the angle hook 21 used therewith and the center of the aperture 32 or the embossment 31.

A different length side plate 41, as shown in FIGS. 6 and 7, is provided. The construction is identical with that of the side plate 19, except that the length is greater and the location of the embossment 31 around the aperture 32 likewise is farther from the angle hook 21. The associated hook 34 is correspondingly longer. Upon initial assembly, the assembler can elect to utilize either a short side plate 19 or a long side plate 41 in order to afford a finished latch unit having the desired backset.

An initially assembled latch unit; for example, with a short side plate 19, can be disassembled by releasing the holder tabs 28, unhooking the side plates from the housing 6 and reassembling the structure with longer side plates 41, making the necessary rotation of the tab ends. During the course of such side plate change, the initial short hook is replaced with a longer hook having the proper dimension for the longer side plates. The net result is to provide a different backset distance going either from a relatively short backset to a long backset or vice versa. Furthermore, by having various side plates of different increments in length as well as hooks of similar length increments, it is easy to supply locksets of any one of a large number of backset dimensions. This is accomplished without varying the bolt mechanism itself and is done simply by providing interchangeable hooks and side plates.

We claim:

1. A changeable backset bolt unit comprising a housing having a side wall and having an end wall with an opening in said end wall, said opening having side edges spaced apart to leave side portions of said end wall, a pair of side plates, means on said side plates for releasably holding said side plates in position relative to each other, angle hooks on said side plates at one end thereof parallel to said end wall and adapted to pass through said opening and engage the inner face of said side portions of said end wall, means on each of said side plates adapted to abut the other side plate when said side plates contact said side edges, and means on each of said side plates adapted to contact the outer face of said end wall when said angle hooks engage the inner face of said side portions of said end wall.

2. A device as in claim 1 in which said means on each of said side plates adapted to abut the other side plate includes a spacer on one of said side plates bent substantially at a right angle from one edge of said one side plate and adapted to abut the side face of the other of said side plates.

3. A device as in claim 1 in which said side plates are identical.

4. In combination, a hollow bolt housing having a longitudinally extending side wall and a transverse end wall with a rectangular opening therein, the edges of said opening being spaced from said side wall; a pair of longitudinally extending, identical side plates, each plate having an integral hook extending transversely from said side plate at one end of said side plate, said hook being adapted to be inserted longitudinally through said opening and together with said side plate to be rotated to dispose said hook transversely against the inside of said end wall and to dispose said side plate extending longitudinally on the outside of said end wall; and a spacer extending transversely from one longitudinal edge of said side plate and adapted to abut the other of said side plates and to position said side plates against said edges of said opening.

5. A structure as in claim 4 including a transversely extending shoulder on said side plate longitudinally spaced from said hook and adapted to abut the outside of said end wall when said hook abuts the inside of said end wall.

6. A structure as in claim 4 including a holder tab integral with the end of said side plate opposite to that of said hook and extending transversely from said side plate in a direction opposite to that of said hook, and means defining shoulders on said holder tab adapted to abut the other of said side plateas.

7. As an article of manufacture, a side plate for use with a duplicate side plate and with a bolt housing comprising a longitudinally extending side plate largely lying in one plane and having side edges, an integral hook extending in one transverse direction from a part only of one end of said side plate to leave an end shoulder on said side plate, a spacer extending transversely from a part only of one of said side edges in a direction opposite said one transverse direction to establish a spacer edge disposed transversely away from said plane, and means in said side plate adjacent the other end thereof defining an opening adjacent one of said side edges adapted to receive a lug and defining a lug adapted to be received in a similar opening.

* * * * *